US007484516B1

(12) United States Patent
Yu

(10) Patent No.: US 7,484,516 B1
(45) Date of Patent: Feb. 3, 2009

(54) OVAL UMBRELLA SYSTEM

(76) Inventor: Garland Ka Lun Yu, A208 Sakura House Monzennakacho, 1-16-8 Saga Koto-ku, Tokyo 135-0031 (JP)

( * ) Notice: Subject to any disclaimer, the term of this patent is extended or adjusted under 35 U.S.C. 154(b) by 293 days.

(21) Appl. No.: 11/161,881

(22) Filed: Aug. 19, 2005

(51) Int. Cl.
*A45B 11/00* (2006.01)
*A45B 19/10* (2006.01)

(52) U.S. Cl. ..... 135/20.1; 135/25.3; 135/31

(58) Field of Classification Search ..... 135/20.1, 135/25.1–25.3, 25.31, 25.32, 31–32, 33.2
See application file for complete search history.

(56) References Cited

U.S. PATENT DOCUMENTS

| | | | | |
|---|---|---|---|---|
| 341,192 | A | 5/1886 | Webster | |
| 2,948,289 | A | 8/1960 | Owczarek | |
| 3,042,055 | A | 7/1962 | Todorovic | |
| 3,837,352 | A | 9/1974 | Weber | |
| 4,474,200 | A | 10/1984 | Kida | |
| 4,474,201 | A | 10/1984 | Kida | |
| 4,838,290 | A * | 6/1989 | Wu | 135/25.31 |
| 5,201,332 | A | 4/1993 | Wu | |
| 5,235,998 | A * | 8/1993 | Liu | 135/25.3 |
| 5,263,505 | A | 11/1993 | Yeom | |
| 5,307,827 | A * | 5/1994 | Haddad et al. | 135/20.1 |
| 5,355,902 | A | 10/1994 | Schlangen | |
| 5,355,903 | A * | 10/1994 | Haddad et al. | 135/20.1 |
| 5,505,221 | A | 4/1996 | Gao | |
| 5,533,535 | A * | 7/1996 | Lin et al. | 135/20.1 |
| 5,642,747 | A | 7/1997 | Rizzotti | |
| 5,725,004 | A | 3/1998 | Moulder | |
| 5,909,746 | A * | 6/1999 | Doster et al. | 135/25.1 |
| 6,412,506 | B1 | 7/2002 | Reese | |
| 2002/0023672 | A1 | 2/2002 | Reese | |
| 2006/0090781 | A1 * | 5/2006 | Lisciandro et al. | 135/20.1 |

FOREIGN PATENT DOCUMENTS

| | | | |
|---|---|---|---|
| JP | 2003310319 | A * | 11/2003 |
| JP | 2005177399 | A * | 7/2005 |
| WO | WO 9618319 | A1 * | 6/1996 |
| WO | WO 9944458 | A1 * | 9/1999 |

* cited by examiner

*Primary Examiner*—Winnie Yip

(57) ABSTRACT

An oval umbrella system (10) for providing improved precipitation protection for individuals. The umbrella system includes a support member (20), a handle member (30) attached to an end of the support member, a collar (22) slidably positioned about the support member, a plurality of first rib linkages (40) extending from the support member, a plurality of second rib linkages (60) extending from the support member, and a covering (80) attached to the rib linkages (40), (60). The first rib linkages preferably have a greater extended length than the second rib linkages.

6 Claims, 13 Drawing Sheets

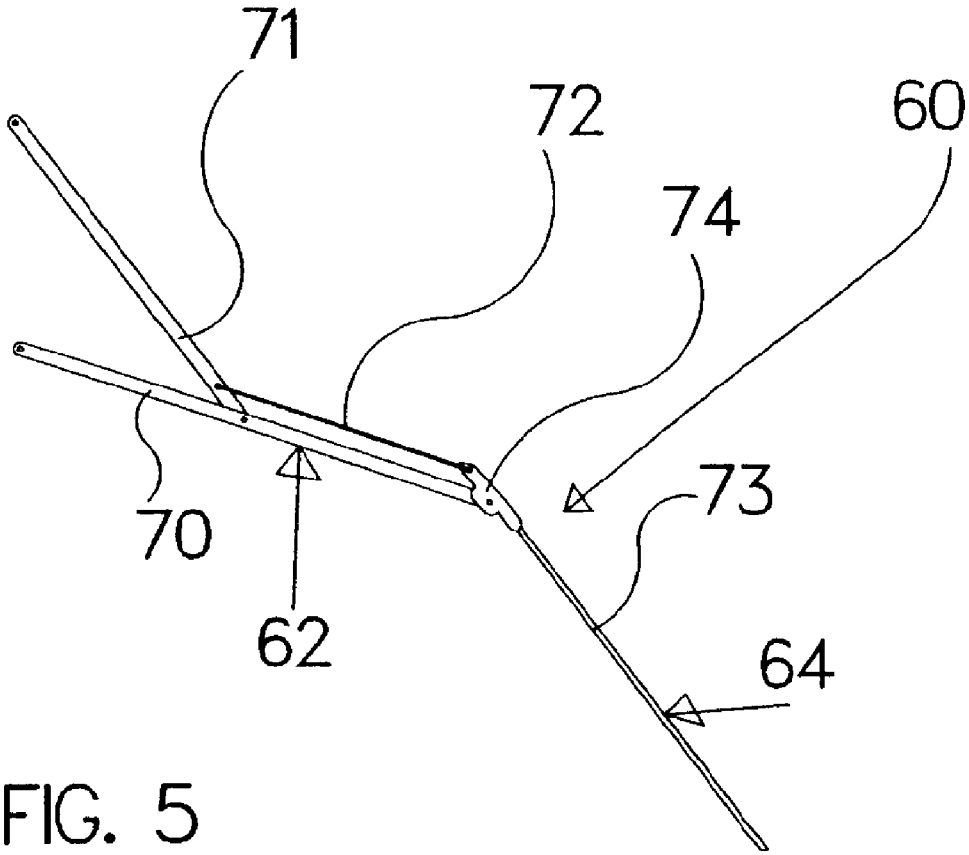
FIG. 5
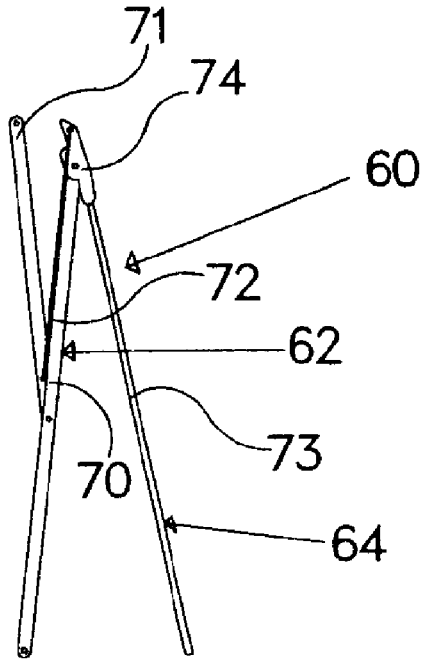

OVAL UMBRELLA SYSTEM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

The present invention relates generally to umbrella devices and more specifically it relates to an umbrella system for providing improved precipitation protection for individuals.

2. Description of the Related Art

Collapsible umbrellas have been in use for years. Conventional collapsible umbrellas manufactured and sold today are typically comprised of an elongate support member, a plurality of multiple section rib linkages pivotally attached to the upper end of the elongate support member, a slidable collar positioned about the elongate support member, a plurality of rib linkage supports extending from the slidable collar outwardly to the rib linkages, and a covering secured about the rib linkages forming a circular shape.

The main problem with conventional collapsible umbrellas is that they do not provide sufficient coverage to individuals walking, particularly individuals with longer strides. The lower legs and feet of the individuals utilizing conventional collapsible umbrellas often become wet from the rain because the umbrella does not extend forwardly or rearwardly sufficiently.

In an attempt to increase the coverage area, collapsible umbrellas have been increased in size around the entire perimeter thereof. The main problem with this improvement is that such umbrellas tend to be bulky and cumbersome to utilize. Another problem is that they are difficult to maneuver in crowded areas because of the extended side portions which are not required.

Examples of patented or patent pending devices which may be related to the present invention include U.S. Pat. No. 5,263,505 to Yeom; U.S. Pat. No. 4,474,200 to Kida; U.S. Pat. No. 341,192 to Webster; U.S. Pat. No. 4,474,201 to Kida; U.S. Pat. No. 5,505,221 to Gao; U.S. Pat. No. 3,837,352 to Weber; U.S. Pat. No. 6,412,506 to Reese; U.S. Pat. No. 3,042,055 to Todorovic; U.S. Pat. No. 5,355,902 to Schlangen; U.S. Pat. No. 2,948,289 to Owczarek; U.S. Pat. No. 5,201,332 to Wu; U.S. Pat. No. 5,725,004 to Moulder; U.S. Pat. No. 5,642,747 to Rizzotti; and U.S. Patent Application No. 2002/0023672 filed by Reese.

While these devices may be suitable for the particular purpose to which they address, they are not as suitable for providing improved precipitation protection and ease of use for individuals.

There have been proposed various umbrellas so designed that the covering is substantially oval when the umbrella is opened.

For example, U.S. Pat. Nos. 4,474,200 and 4,474,201 to Kida (hereinafter collectively referred to as the reference 1) disclose umbrellas comprising main ribs with slidable members and center poles with intermediate and lower hubs slidably fitted thereon. The presence of the main ribs with slidable members and the intermediate and lower hubs complicates the production and adds to the weight of the umbrella. Furthermore, the manner for opening the completely collapsed reference 1 requires that the user pull the top of the center pole away from the handle, which is very awkward and counter-intuitive. When the reference 1 is collapsed, the covering produces a surplus of covering material which folds outwardly and becomes very unsightly and difficult to handle.

The umbrella disclosed in U.S. Pat. No. 3,837,352 to Weber (hereinafter referred to as the reference 2) also comprises telescoping dome ribs and multiple runners similar to the reference 1. As a result, the reference 2 suffers from some of the same limitations as the previously discussed reference 1; namely, complex production, added weight and the existence of a surplus of covering material which folds outwardly and is unsightly and difficult to handle.

In these respects, the umbrella system according to the present invention substantially departs from the conventional concepts and designs of the prior art, and in so doing provides an apparatus primarily developed for the purposes of providing improved precipitation protection and ease of use for individuals.

BRIEF SUMMARY OF THE INVENTION

In view of the foregoing disadvantages inherent in the known types of umbrella devices now present in the prior art, the present invention provides a new umbrella system construction wherein the same can be utilized for providing improved precipitation protection for individuals.

The general purpose of the present invention, which will be described subsequently in greater detail, is to provide a new umbrella system that has many of the advantages of the umbrella devices mentioned heretofore and many novel features that result in a new umbrella system which is not anticipated, rendered obvious, suggested, or even implied by any of the prior art umbrella devices, either alone or in any combination thereof.

To attain this, the present invention generally comprises a support member, a handle member attached to an end of the support member, a collar slidably positioned about the support member, a plurality of first rib linkages extending from the support member, a plurality of second rib linkages extending from the support member, and a covering attached to the rib linkages. The first rib linkages preferably have a greater extended length than the second rib linkages.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an umbrella system with multi-section rib linkages that will overcome the shortcomings of the prior art devices.

A second object is to provide an umbrella system for providing improved precipitation protection for individuals.

Another object is to provide an umbrella system that is easy to utilize and convenient to transport.

An additional object is to provide an umbrella system that is collapsible into a compact structure.

A further object is to provide an umbrella system that adequately protects the lower front and lower rear leg portions of an individual.

Another object is to provide an umbrella system that has an elongate structure for protecting the front and rear portions of the individual from precipitation such as rain, sleet or snow.

An additional object is to provide an umbrella system that is simple to manufacture and operate.

A further object is to provide an umbrella system that may be manually opened and closed or automatically opened and closed.

Another object is to provide an umbrella system where the distal ends of the rib linkages automatically lie on the same plane when the umbrella system is either open or closed.

An additional object is to provide an umbrella system that closes conveniently without an outwardly folded surplus of covering.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 5 is a side elevational view of the second rib linkage in the expanded and contracted positions.

FIG. 12(*a*) is a side cutaway view of the embodiment of FIG. 12 in the contracted position.

FIG. 13(*a*) is a side cutaway view of the embodiment of FIG. 13 in the contracted position.

DETAILED DESCRIPTION OF THE INVENTION

Figure 1:
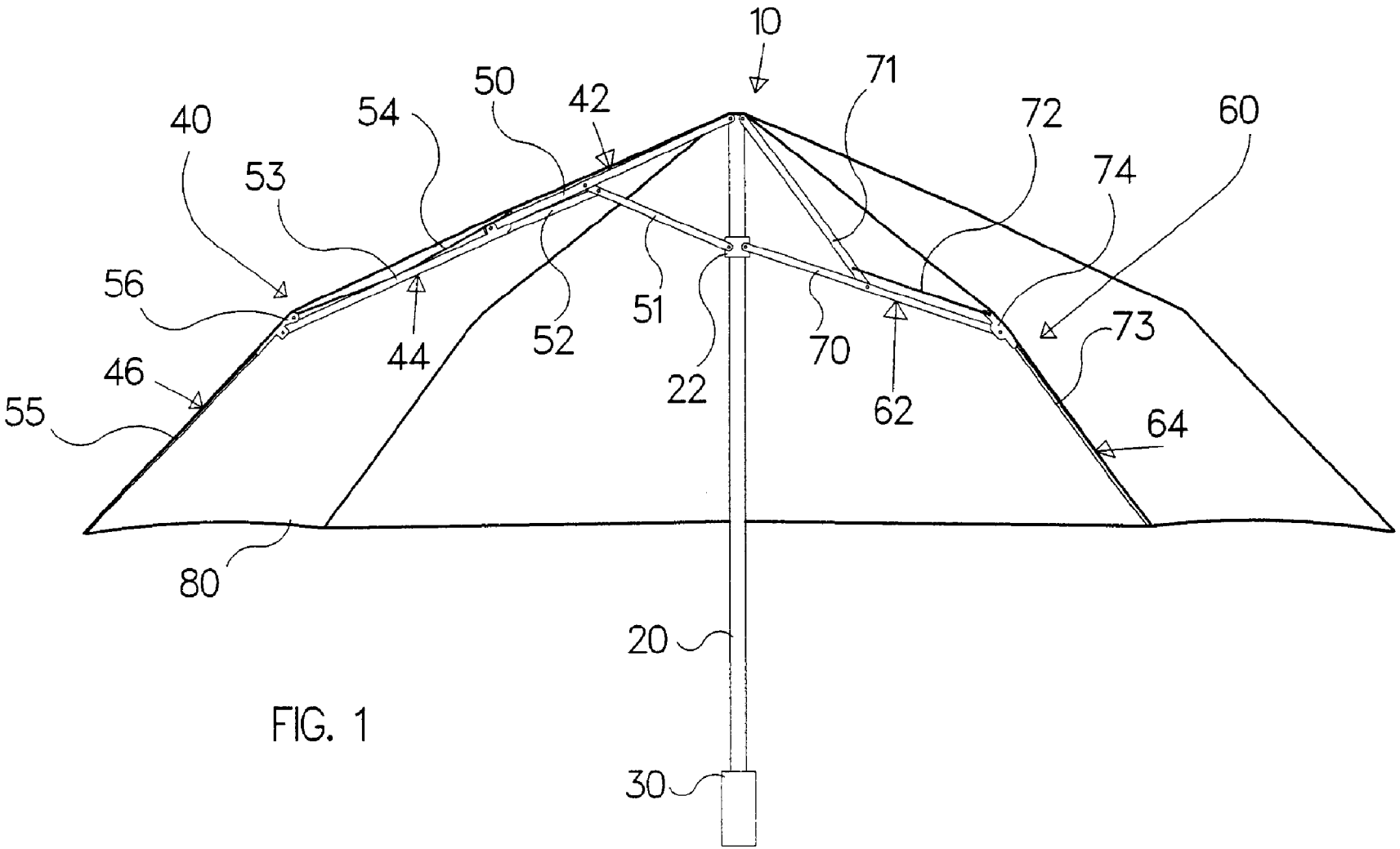
FIG. 1 is a side cutaway view of the present invention in the expanded position.

Turning now descriptively to the drawings, in which similar reference characters denote similar elements throughout the several views, FIGS. 1 through 13(*a*) illustrate an umbrella system 10, which comprises a support member 20, a handle member 30 attached to an end of the support member 20, a collar 22 slidably positioned about the support member 20, a plurality of first rib linkages 40 extending from the support member 20, a plurality of second rib linkages 60 extending from the support member 20, and a covering 80 attached to the rib linkages 40, 60. The first rib linkages 40 preferably have a greater extended length than the second rib linkages 60.

Figure 2:
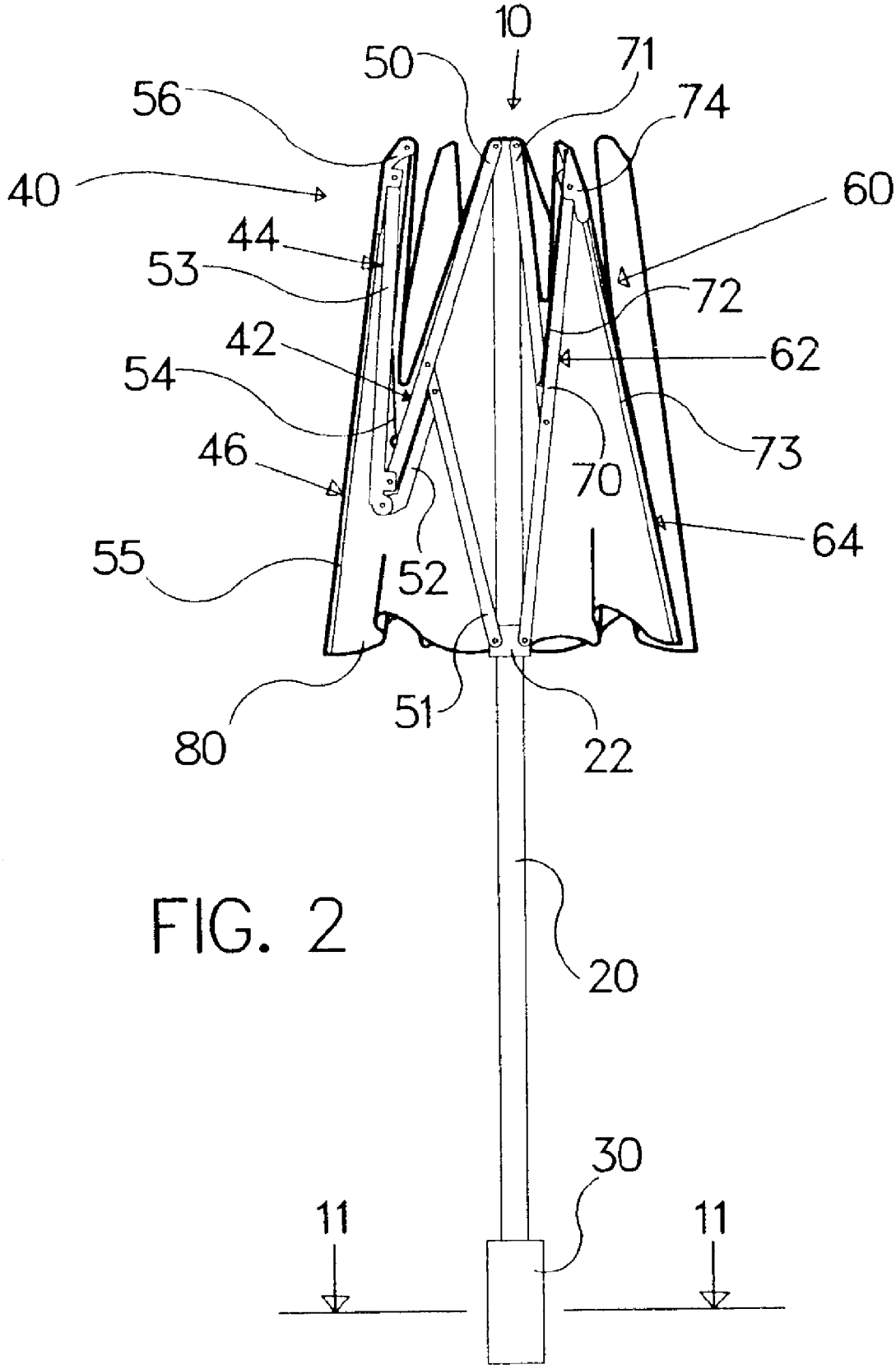
FIG. 2 is a side cutaway view of the present invention in the contracted position.
Figure 3:
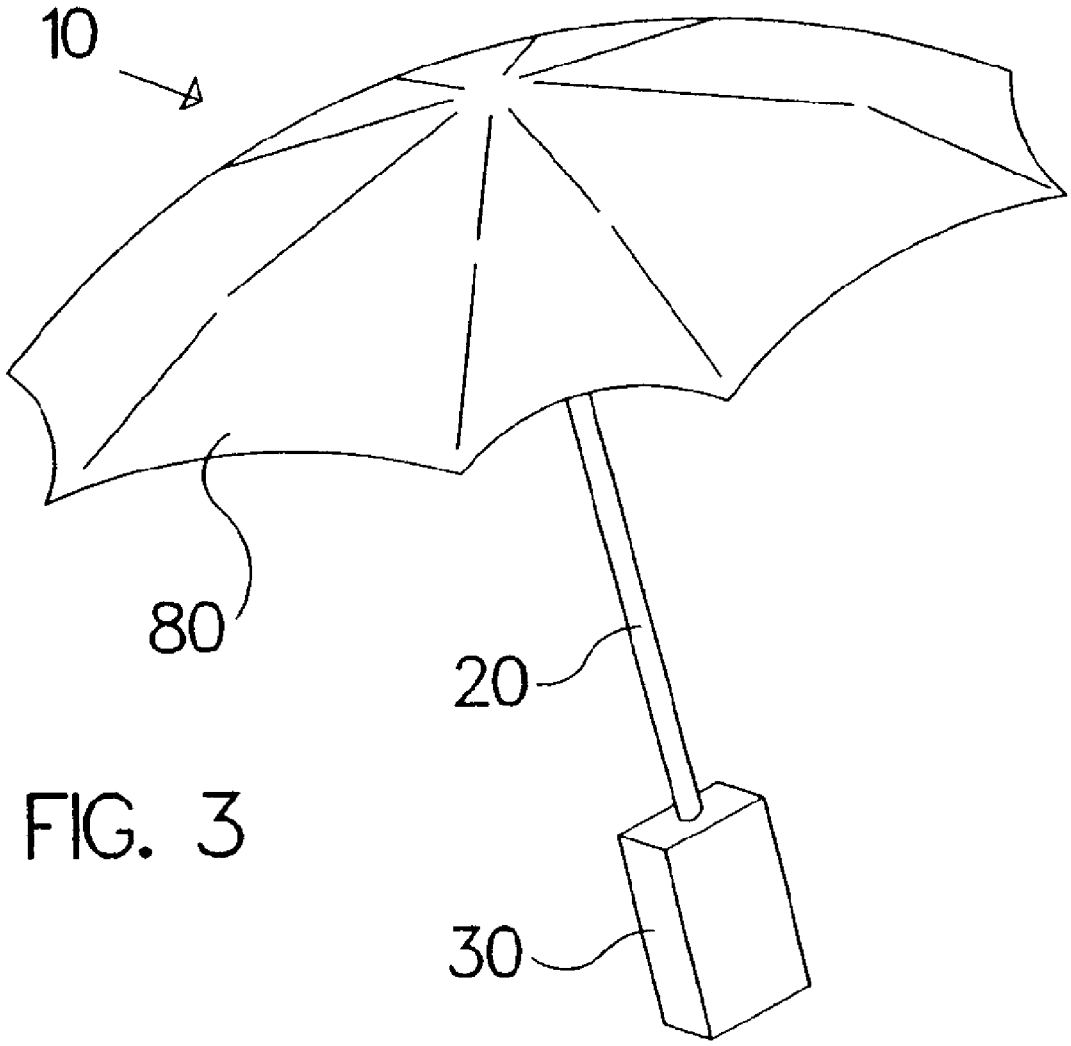
FIG. 3 is an upper perspective view of the present invention.
Figure 4:
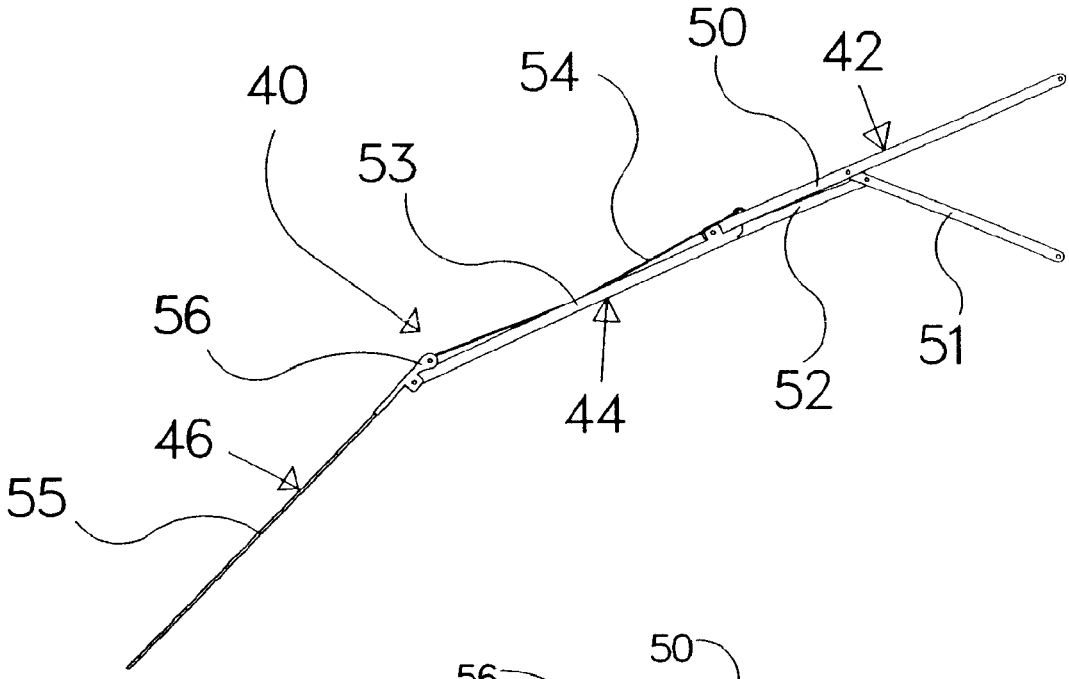
FIG. 4 is a side elevational view of the first rib linkage in the expanded and contracted positions.
Figure 4:
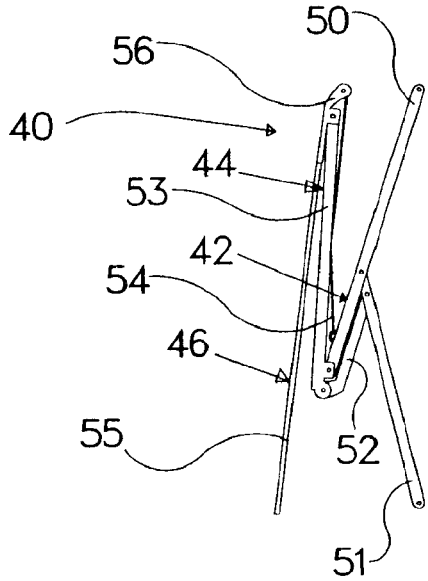

FIGS. 1 through 3 illustrate the support member 20 having an elongate structure. The support member 20 may be comprised of any elongate structure capable of supporting the rib linkages 40, 60 and the covering 80. The support member 20 may have a tubular, solid, telescopic or other structure which are well known in the art of umbrellas.

Figure 6:
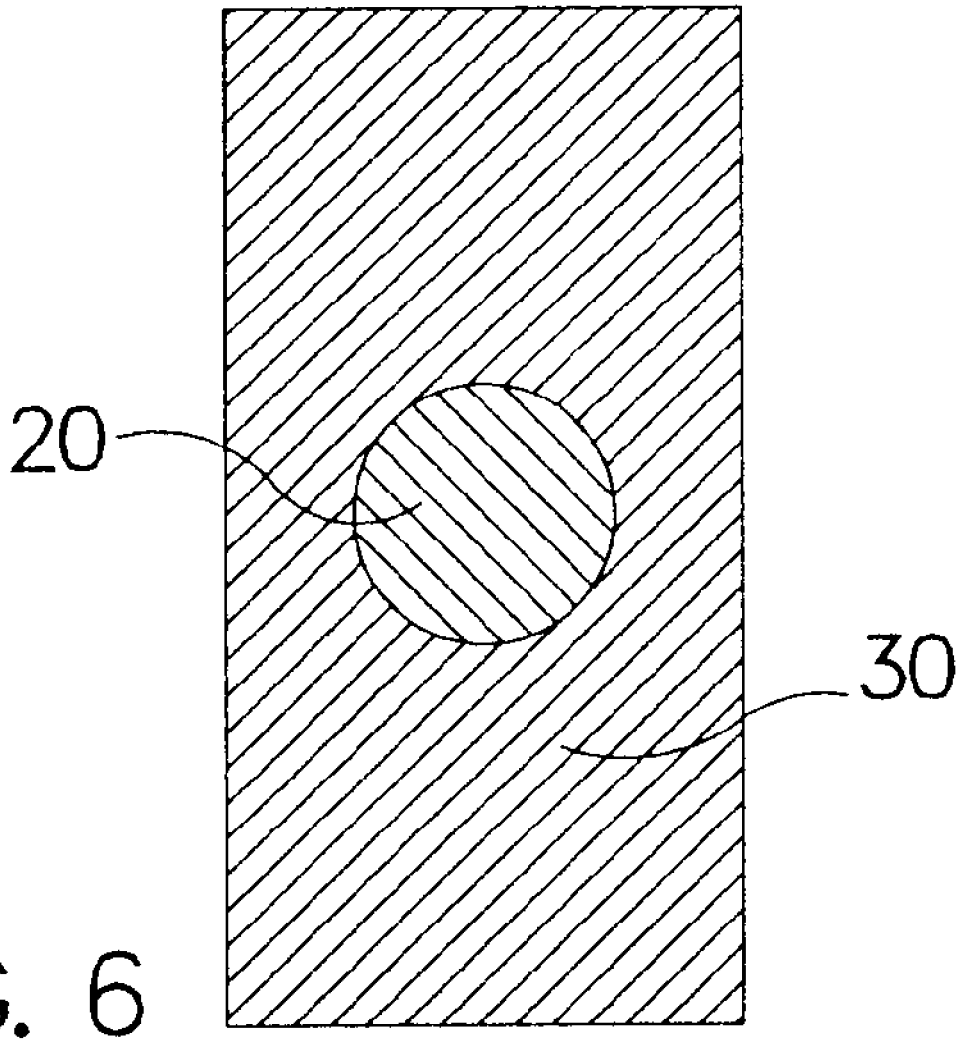
FIG. 6 is a cross sectional view taken along line 11-11 of FIG. 2 illustrating the handle structure.
Figure 8:
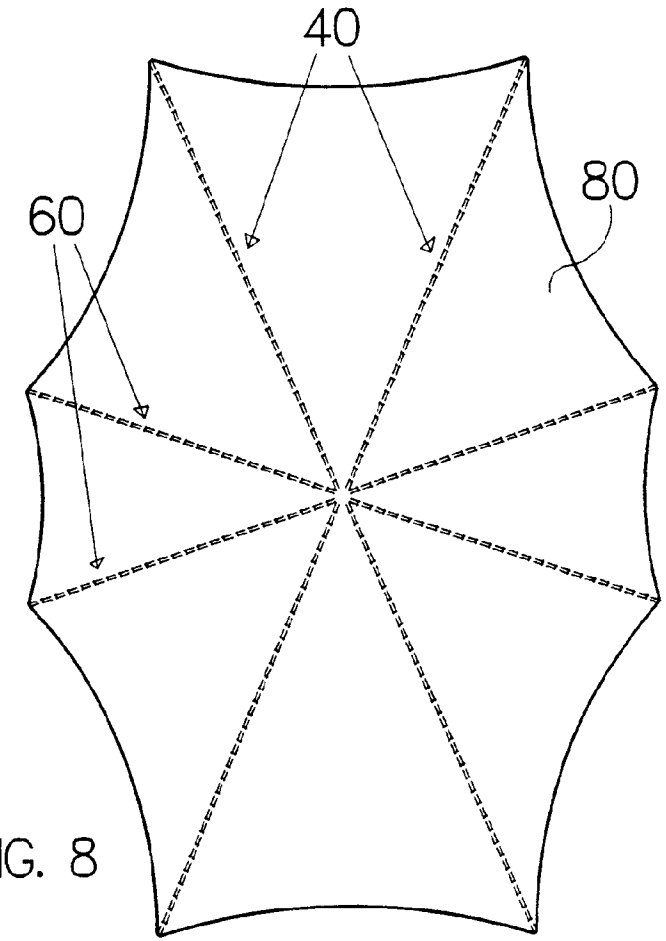
FIG. 8 is a top view of a first alternative shape.
Figure 7:
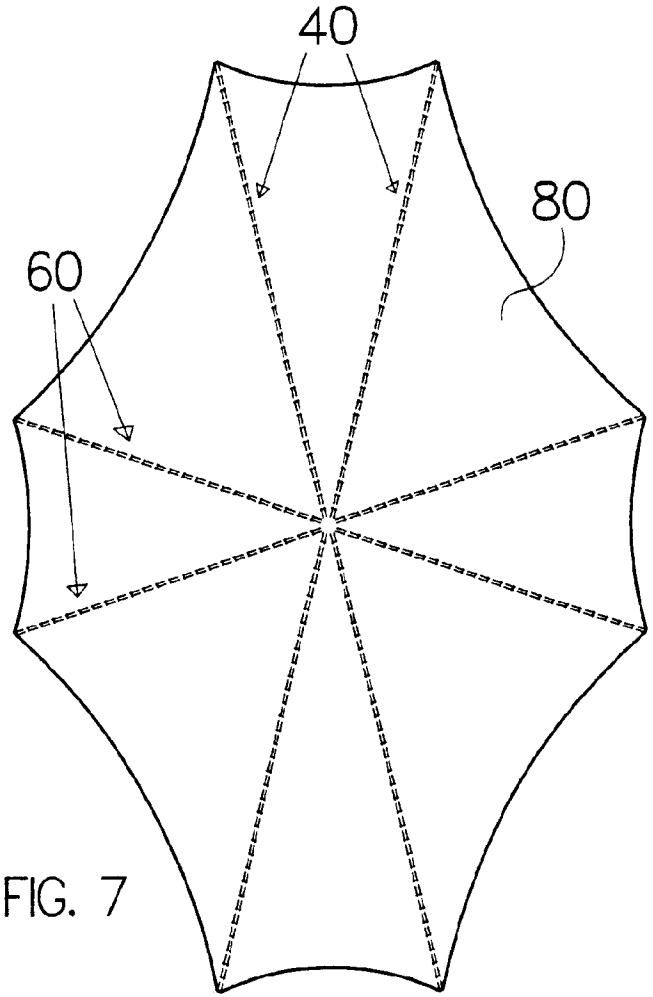
FIG. 7 is a top view of the present invention.
Figure 10:
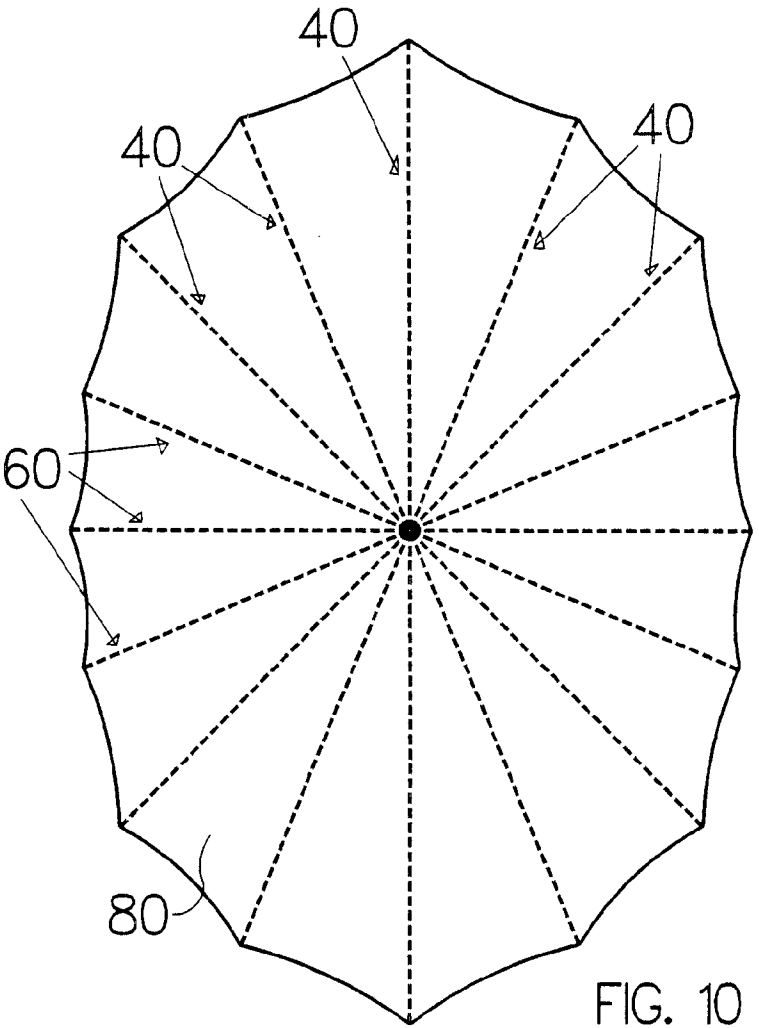
FIG. 10 is a top view of a third alternative shape.
Figure 9:
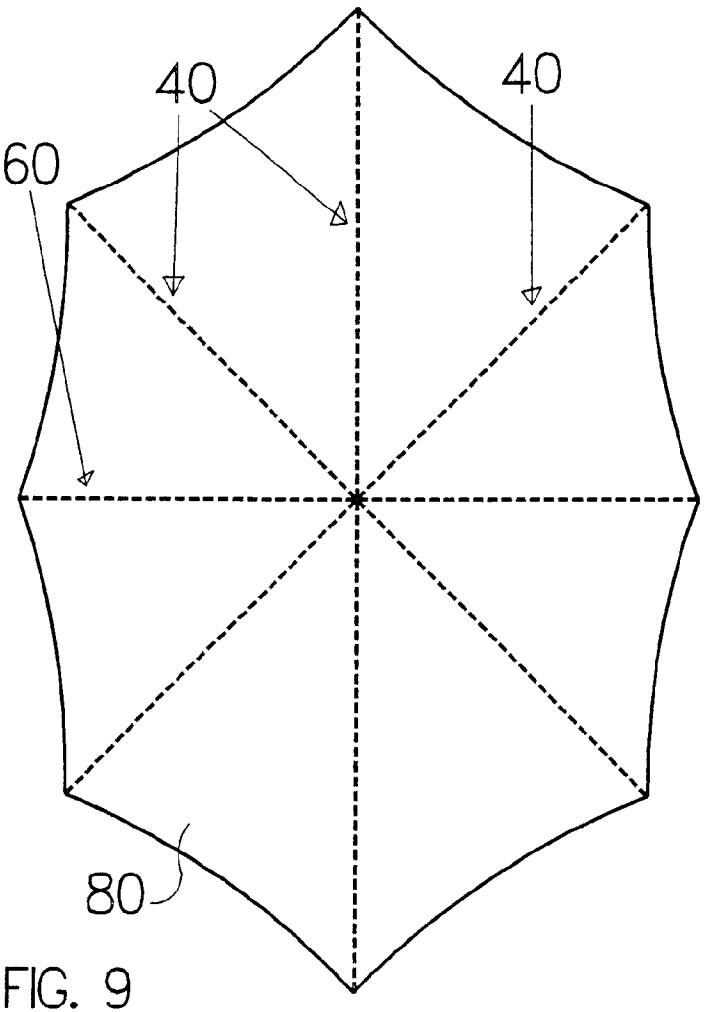
FIG. 9 is a top view of a second alternative shape.

A handle member 30 is preferably attached to a lower end of the support member 20 as shown in FIGS. 1 through 3 of the drawings. The handle member 30 preferably has an elongate cross sectional shape as shown in FIG. 6 of the drawings. The handle member 30 may have various longitudinal cross sectional shapes such as but not limited to oval, elliptical, rectangular, triangular, oblong, polygonal and the like. The longitudinal direction of the handle member 30 is preferably parallel to a longitudinal direction of the covering 80 to assist the individual in determining the longest portion of the covering 80. The handle member 30 may be constructed of any type of material desired for grasping by an individual such as rubber, plastic, wood, composite or other materials.

As shown in FIGS. 1 and 2 of the drawings, a plurality of first rib linkages 40 and second rib linkages 60 are pivotally attached to the upper end of the support member 20 and to the collar 22. The collar 22 is slidably positioned about the support member 20 for moving toward the handle member 30 when the umbrella system 10 is closed and for moving away from the handle member 30 when the umbrella system 10 is opened.

In the preferred embodiment, the first rib linkage 40 is preferably longer than the second rib linkage 60 when fully extended as best illustrated in FIGS. 1, 4, 5 and 7 of the drawings. When the rib linkages 40, 60 are folded as show in FIG. 2 of the drawings, the respective lengths are preferably relatively close.

The first rib linkage 40 has three rib linkage sections, i.e., a first inner linkage 42 section, a first middle linkage 44 section, and a first outer rib 46 section. The first inner linkage 42 section has a first stretcher rib 50 pivotally attached to the top of the support member 20 and a first control rib 53, a first strut 51 pivotally attached to the collar 22 and to the first stretcher rib 50 approximately medially along the first stretcher rib's 50 length, and a first link 52 pivotally attached to the first strut 51 approximately medially along the first strut's 51 length and to one end of the first control rib 53. As will be understood by those in the art, the first inner linkage 42 section, first middle linkage 44 section and first outer rib 46 section are pivotally attached to each other and to the support member 20 by means in which the first rib linkage 40 is allowed to pivot at each point of attachment.

The first middle linkage 44 section has a first control rib 53 pivotally attached to the first inner linkage 42 section, and a first tension rib 54 also pivotally attached to the first inner linkage 42 section that springably acts to help extend the first rib linkage 40 and maintain the umbrella system 10 open. The first control rib 53 is preferably comprised of a U-shaped structure for receiving a portion of the first tension rib 54 thereby creating an increased compact structure. The first outer rib 46 section has a first outer dome rib 55 pivotally attached to the first control rib 53, the first tension rib 54 and the outer periphery or margin of the covering 80 to stretch the covering 80 open when a user opens the umbrella system 10.

The second rib linkage 60 has two rib linkage sections, i.e., a second inner linkage 62 section and a second outer rib 64 section. The second inner linkage 62 section has a second stretcher rib 70 pivotally attached to the collar 22 and a second outer dome rib 73, a second strut 71 pivotally attached to the top of the support member 20 and to the second stretcher rib 70 approximately medially along the second stretcher rib's 70 length, and a second link 72 pivotally attached to the second strut 71 approximately medially along the second strut's 71 length and to one end of the second outer dome rib 73. As will be understood by those in the art, the second inner linkage 62 section and second outer rib 64 section are pivotally attached to each other and to the support member 20 by means in which the second rib linkage 60 is allowed to pivot at each point of attachment. The second outer rib 64 section has a second outer dome rib 73 pivotally attached to the second stretcher rib 70, the second link 72 and the outer periphery or margin of the covering 80 to stretch the covering 80 open when a user opens the umbrella system 10.

The covering 80 may be comprised of various materials such as but not limited to nylon, polyester, cotton, canvas, plastic and the like. The covering 80 is secured to the rib linkages 40, 60 and may be loosely tied with thread (not shown) adjacent to the first pivot joint 56 and second pivot joint 74, and along the lengths of the first stretcher rib 50, the first control rib 53, the second stretcher rib 70 and the second strut 71, thereby keeping the covering 80 in close proximity to the first rib linkages 40 and second rib linkages 60 as the umbrella system 10 is opened and closed. When the umbrella system 10 is closed, the covering 80 can thereby be easily furled, because the covering 80 is folded neatly against the rib linkages 40, 60 without the occurrence of an outwardly folded surplus of covering.

As shown in FIGS. 7, 8, 9, 10 of the drawings, it is desirable to have a plurality of first rib linkages 40 extending to the opposing sides of the support member 20 with a plurality of second rib linkages 60 extending to the opposing sides of the support member 20. This structure forms a longitudinal structure for protecting the front and rear portions of the individual. The covering 80 is formed to fit in the desired pattern as defined by the rib linkages 40, 60. The first outer dome rib 55 and the second outer dome rib 73 preferably have similar lengths so that when the umbrella system 10 is closed, the ends of the first outer dome rib 55 and the second outer dome rib 73 automatically lie on the same plane.

The manner of using the present invention is similar to that of conventional collapsible umbrellas. Namely, as the collar 22 is raised along the support member 20, the rib linkages 40, 60 extend outwardly. Since the covering 80 is pulled outwardly by the rib linkages 40, 60, the covering 80 is spread out into a longitudinal shape of a top view thereof. In order to close the umbrella system 10, a reverse sequence is followed when the collar 22 is lowered toward the handle member 30. The rib linkages 40, 60 retract inwardly toward the support member 20, and the covering 80 folds neatly against the rib linkages 40, 60.

Figure 11:
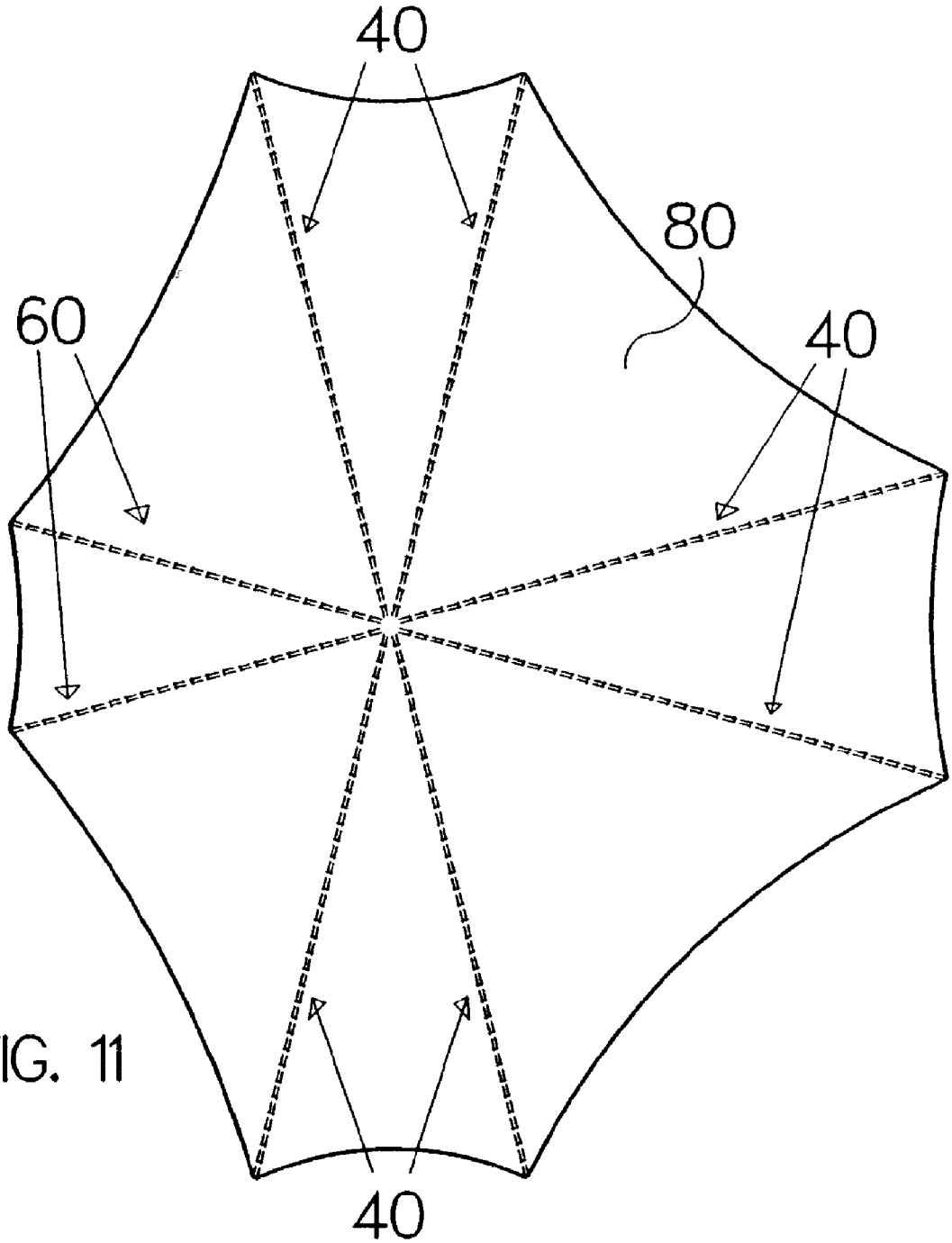
FIG. 11 is a top view of an alternative embodiment of the present invention off-centered in a right-side manner.

FIG. 11 illustrates an alternative embodiment where the first rib linkages 40 extend forwardly, rearwardly and to one side of the support member 20 with the second rib linkages 60 extending to the opposing side of the support member 20. This structure allows for the user to retain the support member 20 to the user's side with one hand while still adequately protecting the opposing side of the user's body. The functions of the umbrella system as described by this embodiment are the same as in the preferred embodiment.

Figure 12:
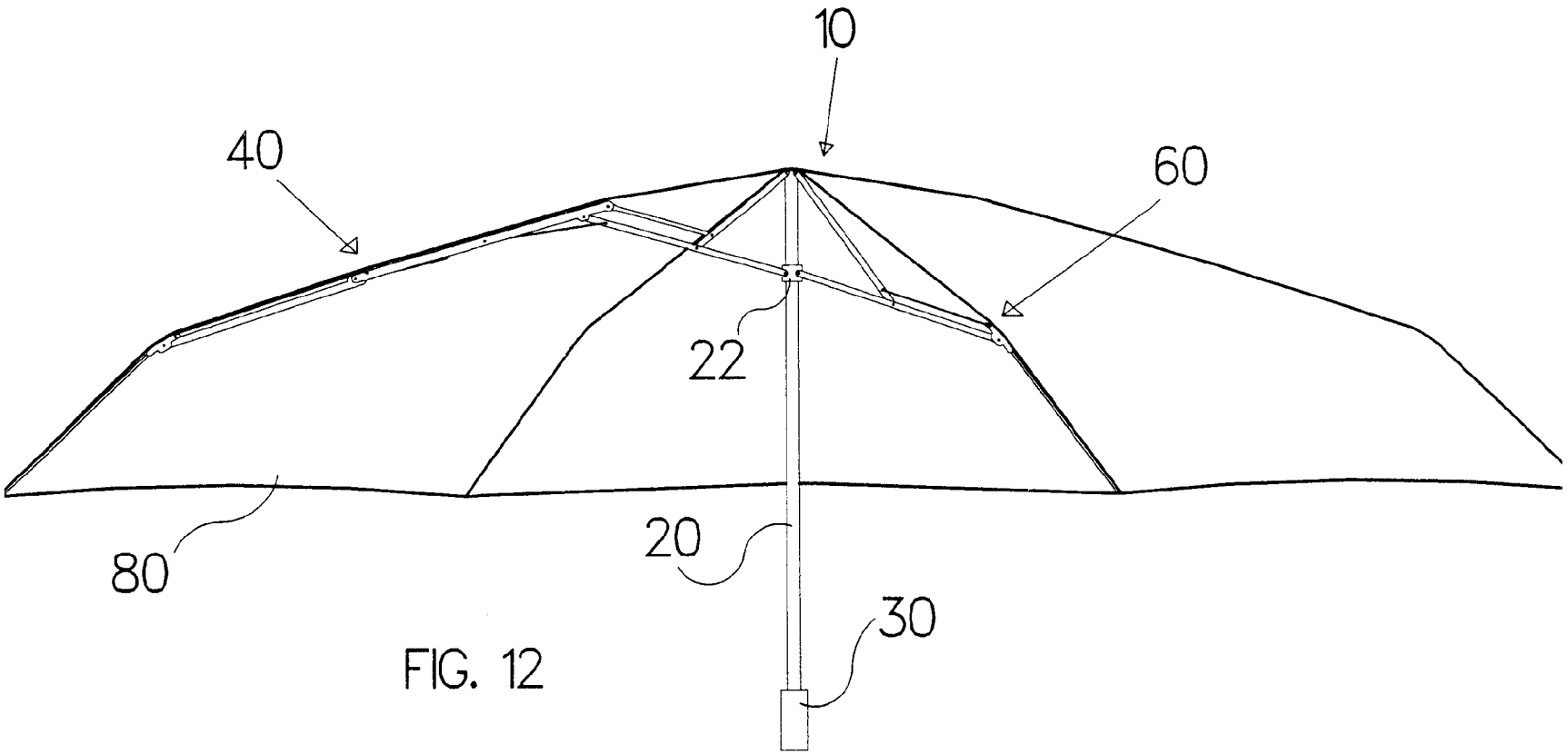
FIG. 12 is a side cutaway view of an alternative embodiment of the present invention in the expanded position.
Figure 12A:
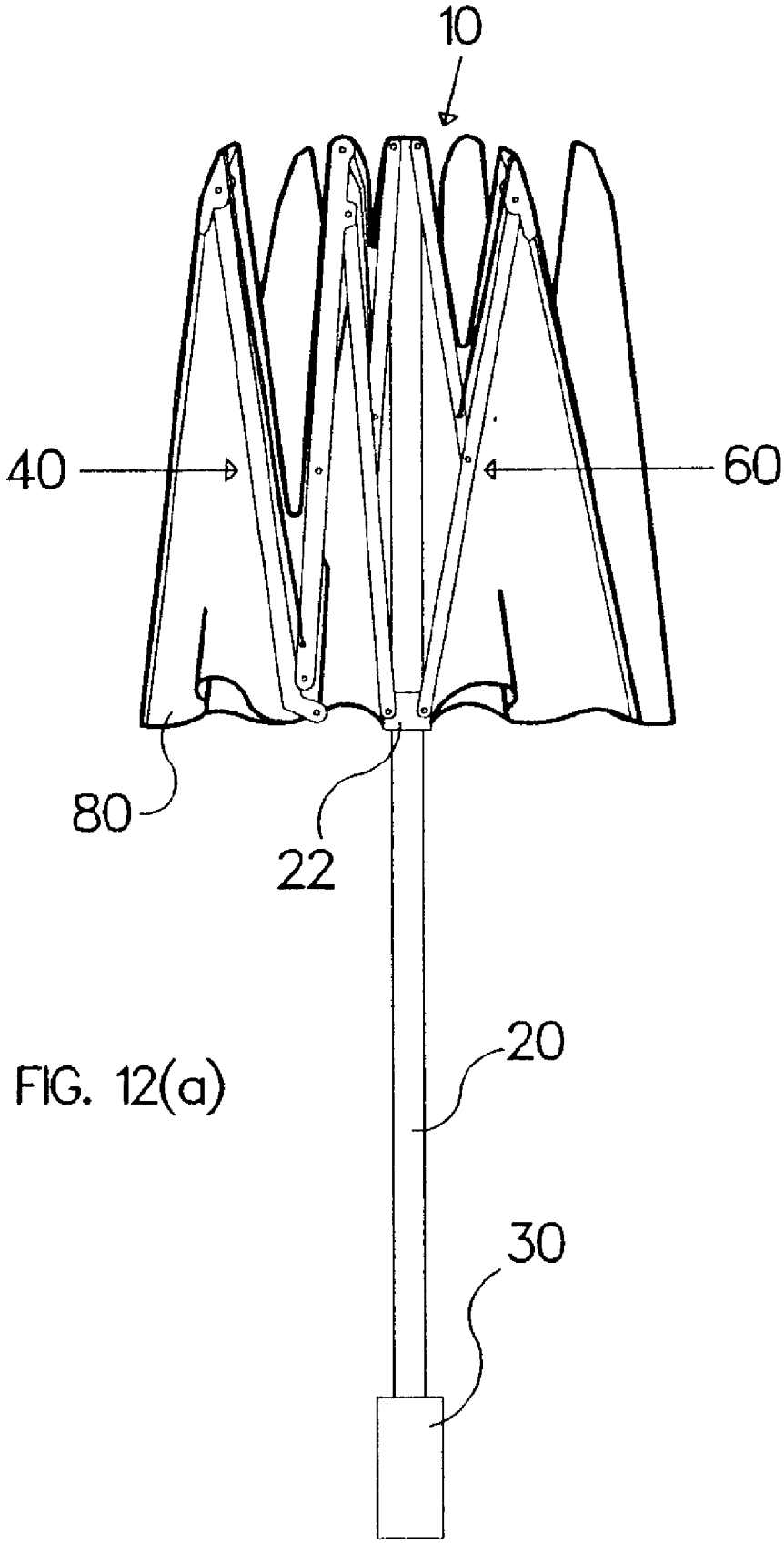
Figure 13:
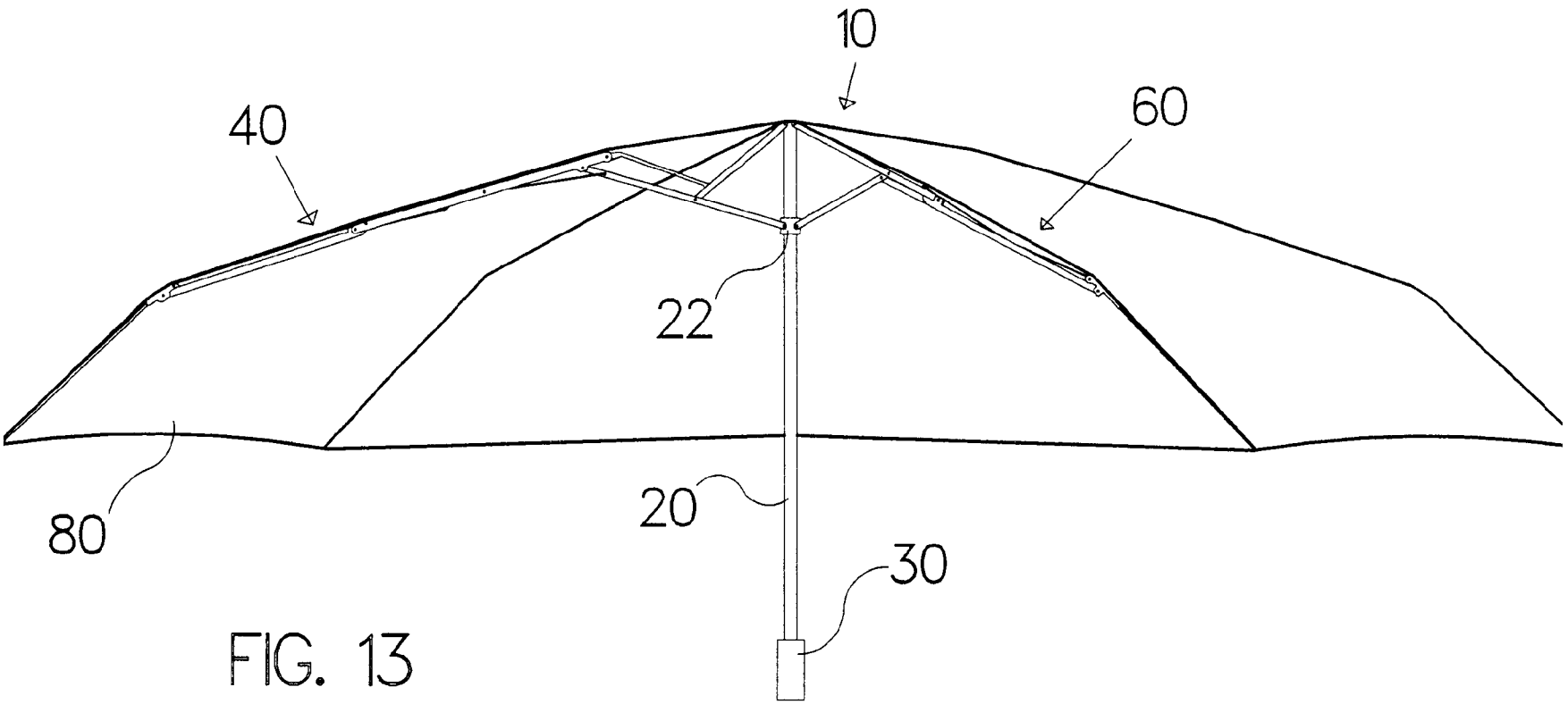
FIG. 13 is a side cutaway view of an alternative embodiment of the present invention in the expanded position.
Figure 13A:
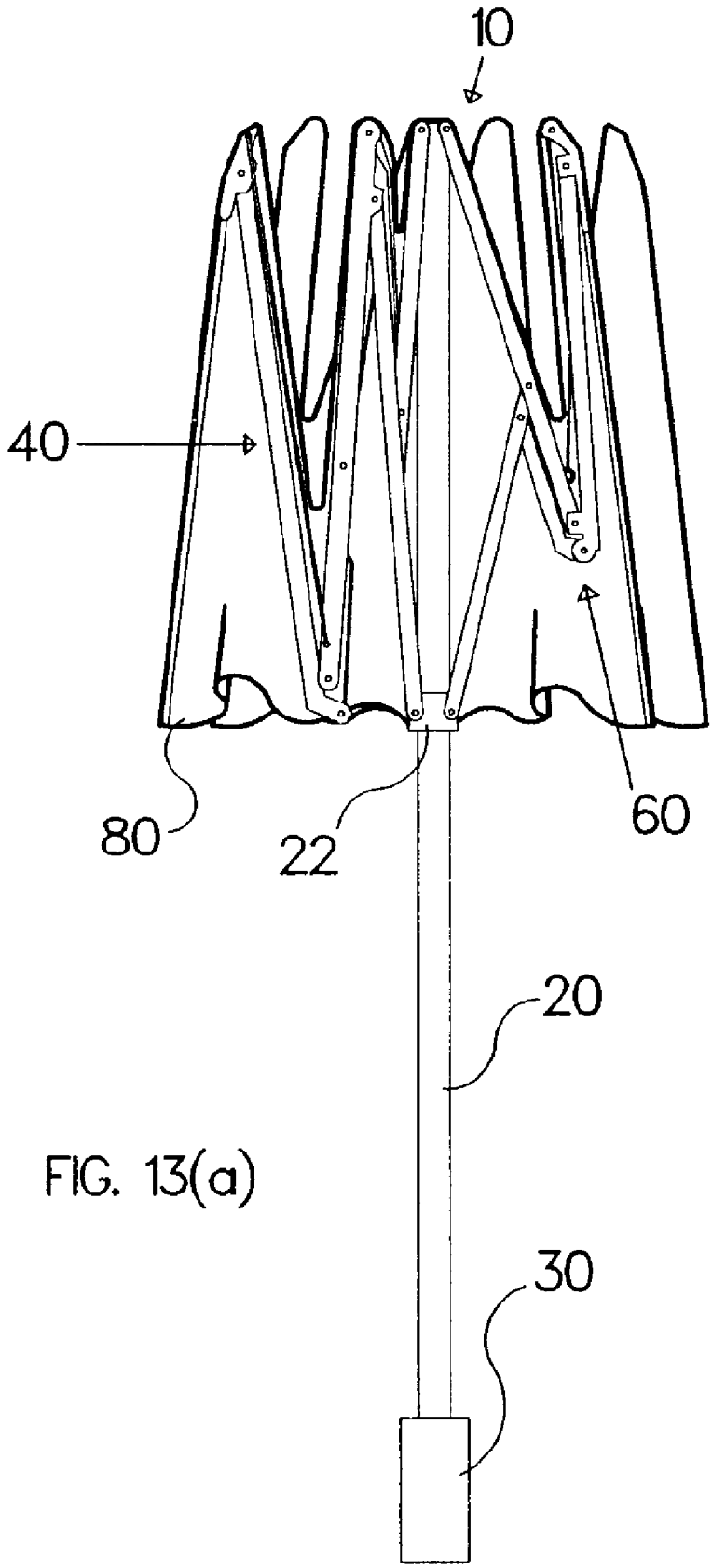

As will be understood by those in the art, the present invention is also applicable to collapsible umbrellas having multi-section rib linkages where the number of rib linkage sections in the first rib linkage 40 is other than three and the number of rib linkage sections in the second rib linkage 60 is other than two. FIGS. 12 and 12(*a*) illustrate an alternative embodiment where the first rib linkages 40 comprise four rib linkage sections and the second rib linkages 60 comprise two rib linkage sections. Correspondingly, the present invention is equally applicable to collapsible umbrellas having multi-section rib linkages where the number of rib linkage sections in the second rib linkage 60 is three. Equivalent to the foregoing FIGS. 12 and 12(*a*), another alternative embodiment is shown in FIGS. 13 and 13(*a*) where the first rib linkages 40 comprise four rib linkage sections and the second rib linkages 60 comprise three rib linkage sections.

The functions of the umbrella systems as described by these embodiments are the same as in the preferred embodiment.

Accordingly, the reader will see that the present invention overcomes the shortcomings of the prior art devices. The present invention is easy to utilize, convenient to transport and collapsible into a compact structure. Furthermore, it provides an elongate structure for protecting the front and rear portions of the individual from precipitation such as rain, sleet or snow. In comparison with prior art devices, the present invention is simple to manufacture and operate. Because the distal ends of the rib linkages 40, 60 automatically lie on the same plane when the umbrella system 10 is either open or closed, the umbrella system 10 operates neatly and is aesthetically pleasing. The present invention also closes conveniently without an outwardly folded surplus of covering 80.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention. Various other configurations may be achieved for the covering 80 by utilizing different configurations for the rib linkages 40, 60.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An oval umbrella system, comprising:

a support member;

a collar slidably positioned upon said support member;

a plurality of first rib linkages extending in a first direction and a second direction from said support member and said collar; each said first rib linkage having a first inner linkage section pivotally attached to said support member and said collar, a first middle linkage section pivotally attached to said first inner linkage section, and a first outer rib section pivotally attached to said first middle linkage section;

a plurality of second rib linkages extending in a third direction and a fourth direction from said support member and said collar; each said second rib linkage having a second inner linkage section pivotally attached to said support member, said collar, and a second outer rib section; wherein said first rib linkages are longer than said second rib linkages when fully extended; and a covering attached to said first rib linkages and said second rib linkages, wherein each said first rib linkage has a first outer dome rib attached to said covering at the distal end of said first outer dome rib and each said second rib linkage has a second outer dome rib attached to said covering at the distal end of said second outer dome rib, each said first outer dome rib and each said second outer dome rib having substantially uniform lengths, wherein each said first inner linkage section has a first stretcher rib pivotally attached to a top of said support member and a first strut pivotally attached to said collar and to said first stretcher rib approximately medially along said first stretcher rib's length, and each said second inner linkage section has a second stretcher rib pivotally attached to said collar and a second strut pivotally attached to a top of said support member and to said second stretcher rib approximately medially along said second stretcher rib's length, wherein the distal ends of said first rib linkages and said second rib linkages lie on the same plane when said covering is collapsed, and wherein the distal ends of said first rib linkages and said second rib linkages lie on the same plane when said covering is opened.

2. The oval umbrella system of claim 1, wherein said first rib linkages form a longitudinal structure.

3. The oval umbrella system of claim 2, including a handle member attached to said support member wherein said handle member has a longitudinal cross sectional shape corresponding to the longitudinal structure of said first rib linkages.

4. The oval umbrella system of claim 2, wherein said first direction is forwardly and said second direction is rearwardly.

5. The oval umbrella system of claim 1, wherein said support member is telescopic in structure.

6. The oval umbrella system of claim 1, wherein each said first rib linkage has at least three rib linkage sections and each said second rib linkage has at least two rib linkage sections.

* * * * *